US005364197A

United States Patent [19]

Powers

[11] Patent Number: 5,364,197

[45] Date of Patent: Nov. 15, 1994

[54] COSMETIC PENCIL WITH DESCENDING SHEATH

[76] Inventor: Ronald J. Powers, 4010 Ischia Dr., Oxnard, Calif. 93035

[21] Appl. No.: 169,210

[22] Filed: Dec. 20, 1993

[51] Int. Cl.[5] ..... A45D 40/06; A45D 40/12; A45D 40/20

[52] U.S. Cl. ..... 401/75; 401/117; 401/194

[58] Field of Search ..... 401/173, 117, 68, 75, 401/76, 79, 194

[56] References Cited

U.S. PATENT DOCUMENTS 4,595,124 6/1986 Duval ..... 401/194 X

FOREIGN PATENT DOCUMENTS 968384 11/1950 France ..... 401/174
2589696 5/1987 France ..... 401/75
652454 4/1951 United Kingdom ..... 401/75
2197783 6/1988 United Kingdom ..... 401/172

*Primary Examiner*—Steven A. Bratlie
*Attorney, Agent, or Firm*—Edgar W. Averill, Jr.

[57] ABSTRACT

A cosmetic pencil for dispensing a soft cosmetic mass. The pencil has a hollow barrel in which a threaded push rod is held. A hollow sheath is filled with a cosmetic mass and threads are provided between the sheath and the push rod so that when the push rod is turned with respect to the sheath the sheath descends into the barrel and the cosmetic mass is exposed by the descending sheath. The relative turning may be either provided by turning the sheath while holding the barrel or turning an actuator at the base of the barrel while holding the barrel. Elongated notches are formed on the inner surface of the barrel and one or more pawls move in and out of the notches and permit the pencil and sheath to be turned in only one direction.

3 Claims, 2 Drawing Sheets

Fig. 1
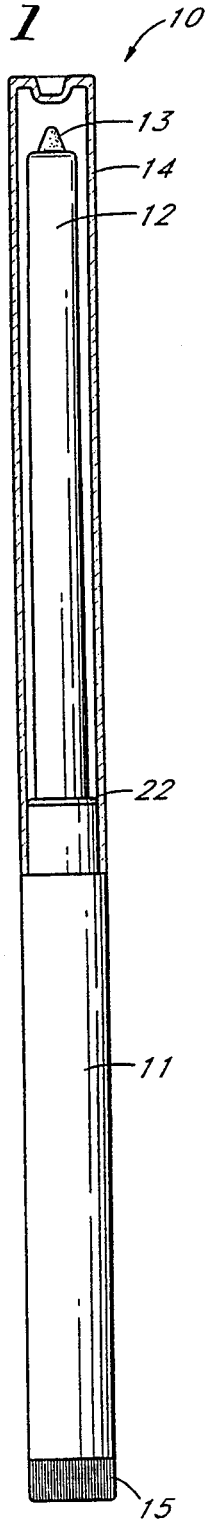
Fig. 2
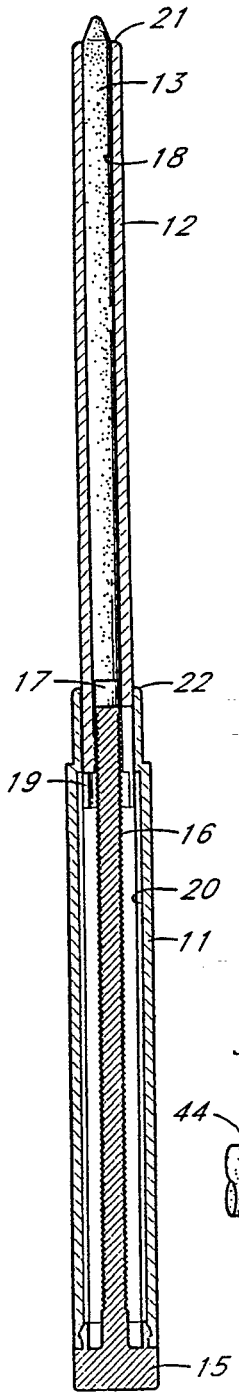
Fig. 3
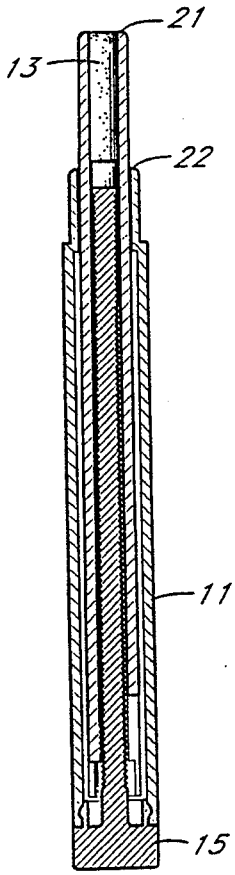
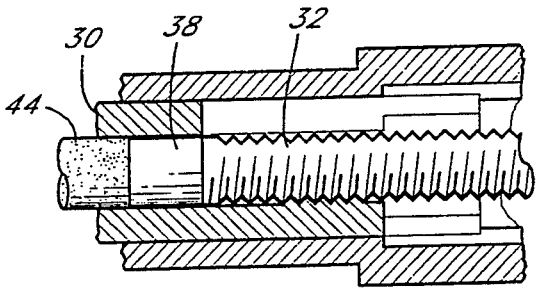
Fig. 7

COSMETIC PENCIL WITH DESCENDING SHEATH

BACKGROUND OF THE INVENTION

The field of the invention is cosmetic pencils and the invention relates more particularly to pencils capable of dispensing a relatively soft cosmetic mass such as that used in an eyebrow pencil.

One such pencil is shown in applicant's U.S. Pat. No. 4,696,594 which utilizes a gripping disk which urges a push rod 22 forward as the pencil is turned. While this device is very effective it does not give any indication of the amount of cosmetic mass left. Also it has a relatively large number of parts. Pencils for dispensing various types of crayons are shown in U.S. Pat. Nos. re. 25,741, 2,081,286, 2,274,311, 2,563,943, 3,219,044, 3,468,612, 3,768,915. A device which shows a descending sheath is shown in U.S. Pat. No. 3,514,211. It is important that the device dispense a very small amount of cosmetic mass as it is turned since only a small amount is used at any one time and if too much is extruded then it will simply break off and be wasted.

BRIEF SUMMARY OF THE INVENTION

It is an object of the present invention to provide a cosmetic pencil which will provide a visual indication of the amount of cosmetic mass used and remaining.

It is another object of the present invention to provide a cosmetic pencil which may only be turned in a positive or feeding direction and which also gives a tactile feel as it is feeding.

The present invention is for a cosmetic pencil comprising an elongated hollow barrel. An elongated push rod is affixed to the bottom of the barrel and the push rod is threaded. A hollow sheath has a threaded portion along its inner surface which mates with the threaded push rod. The sheath is filled with a cosmetic mass and as the sheath is turned with respect to the push rod the sheath moves downwardly into the barrel and the push rod extends into the sheath and pushes the cosmetic mass out of the top of the sheath. The push rod and sheath may be turned with respect to each other either by turning a push rod actuator at the bottom of the barrel or by turning the barrel and push rod and holding the sheath.

BRIEF DESCRIPTION OF THE DRAWINGS

FIG. 1 is a side view partly in cross-section of the cosmetic pencil of the present invention.

FIG. 2 is a cross-sectional view of the cosmetic pencil of FIG. 1.

FIG. 3 is a cross-sectional view of the cosmetic pencil of FIG. 1 with the cosmetic mass entirely used.

FIG. 7 is a cross-sectional view taken along line 7—7 of FIG. 4.

DESCRIPTION OF THE PREFERRED EMBODIMENTS

Figure 4:
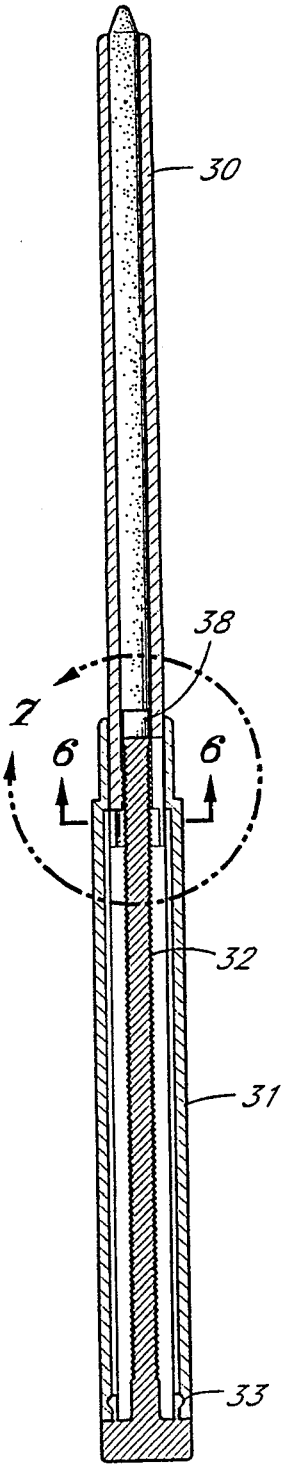
FIG. 4 is a cross-sectional side view of an alternate embodiment of the cosmetic pencil of FIG. 1.

The cosmetic pencil of the present invention is shown in side view in FIG. 1 and indicated generally by reference character 10. Cosmetic pencil 10 has a barrel 11, a sheath 12, a crayon or cosmetic mass 13 and a cap 14. As shown in FIG. 2 an actuator 15 is rotatably held in barrel 11 and is integral with a threaded push rod 16. Threaded push rod 16 has an enlarged plunger 17 which tightly fits within the cylindrical interior 18 of sheath 12. Sheath 12 has three tabs 19 which fit within grooves 20 on the interior surface of barrel 11 to prevent sheath 12 from turning with respect to barrel 11.

The cosmetic mass 13 moves out from the end 21 of sheath 12 when actuator 15 is turned and barrel 11 is held. This causes a threading movement which pulls sheath 12 downwardly into the barrel and since plunger 17 is fixed with respect to the barrel 11 the cosmetic mass 13 is exposed by the receding sheath 12 as shown in FIG. 3. When sheath 12 is completely retracted the end 21 is close to the end 22 of barrel 11.

Figure 5:
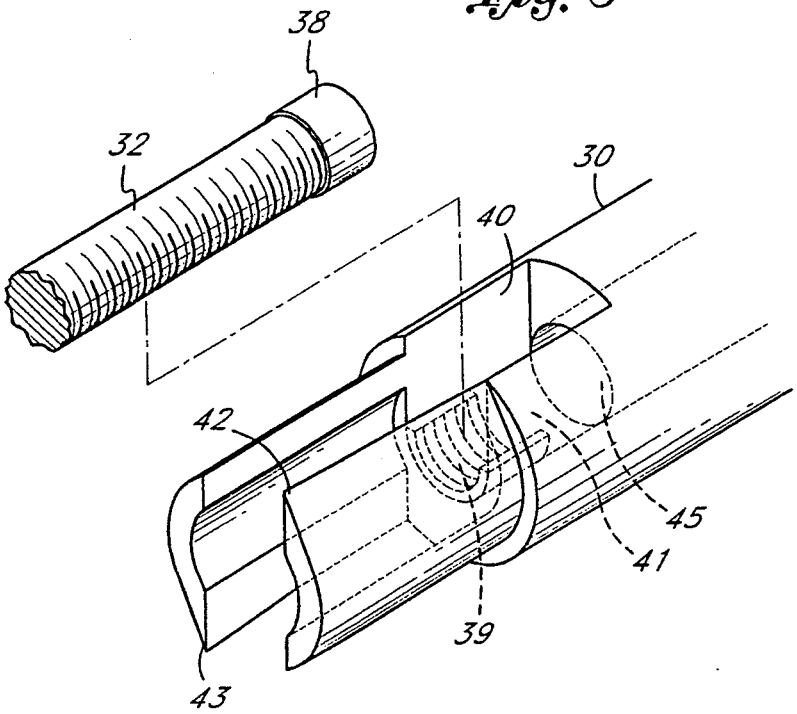
FIG. 5 is an exploded perspective view of the tip of the push rod and the base of the sheath of the cosmetic pencil of FIG. 4.
Figure 6:
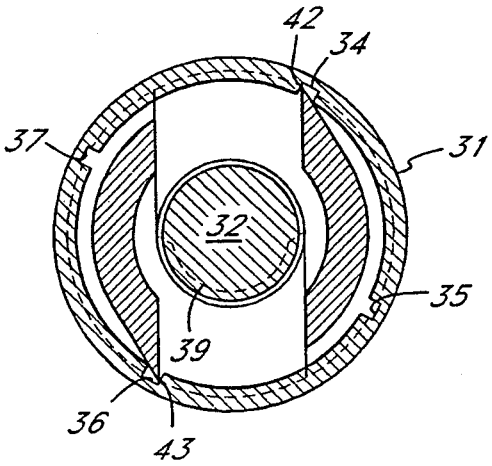
FIG. 6 is a cross-sectional view taken along line 6—6 of FIG. 5.

An alternate embodiment of the present invention is shown in FIGS. 4 through 7 where the sheath 30 is turned with respect to barrel 31. The threaded push rod 32 is affixed at 33 to barrel 31 so that it will not turn with respect to barrel 31. As in the version shown in FIG. 1, barrel 31 is provided with notches and more specifically as shown in FIG. 6 barrel 31 has four notches indicated by reference characters 34, 35, 36 and 37. Threaded push rod 32 has an enlarged plunger 38 as shown best in FIG. 5 and a novel method of inserting the threaded push rod into the base of sheath 30 is illustrated in FIG. 5. A half thread 39 is formed at the base of slot 40 and the threaded portion of push rod 32 may be snapped into the half thread 39 with the enlarged plunger 38 passing down into the plunger receiving pocket 41 without having to pass through threads 39. Enlarged plunger 38 may either be an integral part of the threaded push rod 32 or may be snapped on as a separate preferably softer material.

Another interesting feature of the present invention is shown best in FIG. 6 where a pair of projecting points 42 and 43 are held in slots 34 and 36 respectively. It can be seen that the barrel 31 can only be turned in one direction with respect to sheath 30 because projecting points 42 and 43 form a ratchet action with respect to the slots 34 and 36 of barrel 31. Furthermore, as the sheath is turned clockwise as viewed in FIG. 6 projecting point 42 will be slightly deflected inwardly until it reaches slot 35 at which point there will be a noticeable tactile click as projecting point 42 falls into slot 35 and projecting point 43 falls into slot 37. This makes it impossible for the user to turn the barrel and sheath in the wrong direction and furthermore gives a tactile as the two pieces are moved with respect to each other.

A side view of the enlarged plunger within sheath 30 contacting cosmetic mass 44 is shown in FIG. 7. Once the threaded push rod 32 is snapped into barrel 31 and the enlarged plunger 38 is held within the barrel 45 of sheath 30 the half threads are held against the threaded portion of threaded push rod 32.

The result is a cosmetic pencil which is easy to use and gives a visual indication of the amount of cosmetic mass used.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A cosmetic pencil for dispensing a soft cosmetic mass, said cosmetic pencil comprising:

an elongated hollow barrel having a bottom, a top, an outer surface and an inner surface, said inner surface having at least one longitudinally directed notch;

an elongated push rod having a bottom and a top and being affixed at the bottom to the bottom of the barrel and said push rod being threaded;

a hollow sheath having a bottom, a top, an outer surface and an inner surface, said sheath having a threaded portion which mates with the threaded push rod, and said sheath being at least partially filled with a cosmetic mass, and wherein said sheath has at least one outwardly and radially directed angled pawl, said pawl extending radially outwardly so that the at least one angled pawl will pass freely in and out of said longitudinally directed notch as the sheath is turned in a first direction with respect to the barrel but will abut and catch the longitudinally directed notch when the sheath is turned in a direction opposite of said first direction with respect to the barrel whereby when said push rod and sheath are turned in said first direction with respect to each other, the sheath moves downwardly into the barrel and the push rod extends into the sheath and pushes the cosmetic mass out of the top end of the sheath but when the push rod and sheath are turned in said direction opposite of said first direction, the turning will stop when said at least one angled pawl enters said at least one longitudinally directed notch.

2. The cosmetic pencil of claim 1 wherein the outer surface of the bottom of the sheath has two pawls and the inner surface of the barrel has at least two longitudinally directed notches.

3. The cosmetic pencil of claim 2 wherein the inner surface of said barrel has four longitudinally directed notches.

* * * * *